US009107550B2

(12) United States Patent
Sergyeyenko et al.

(10) Patent No.: US 9,107,550 B2
(45) Date of Patent: Aug. 18, 2015

(54) COMPACT VACUUM AND SANDER

(71) Applicant: Black & Decker Inc., Newark, DE (US)

(72) Inventors: Oleksiy Sergyeyenko, Baldwin, MD (US); David A. Miller, Baltimore, MD (US); Joseph B. Cooper, Baltimore, MD (US); Brian Poole, Towson, MD (US)

(73) Assignee: BLACK & DECKER INC., Newark, DE (US)

( * ) Notice: Subject to any disclaimer, the term of this patent is extended or adjusted under 35 U.S.C. 154(b) by 42 days.

(21) Appl. No.: 14/039,438

(22) Filed: Sep. 27, 2013

(65) Prior Publication Data

US 2015/0093973 A1 Apr. 2, 2015

(51) Int. Cl.

| | |
|---|---|
| ***A47L 7/00*** | (2006.01) |
| ***B24B 55/10*** | (2006.01) |
| ***A47L 5/24*** | (2006.01) |

(52) U.S. Cl.

CPC ..... *A47L 7/0095* (2013.01); *A47L 5/24* (2013.01); *B24B 55/10* (2013.01)

(58) Field of Classification Search

CPC ..... B24B 55/06; B24B 55/08; B24B 55/10; B24B 55/102; B24B 55/105; B24B 55/107; B23Q 11/0071; A47L 5/00; A47L 7/0095; A47L 9/2842; A47L 5/24

USPC ..... 15/300.1, 347; 55/DIG. 3; 451/453, 456

See application file for complete search history.

(56) References Cited

U.S. PATENT DOCUMENTS

| | | | | |
|---|---|---|---|---|
| 1,420,665 | A | | 6/1922 | Newcombe |
| 2,049,603 | A | | 8/1936 | Dietenberger |
| 2,149,135 | A | | 2/1939 | Eriksson-Jons |
| 2,171,248 | A | | 8/1939 | Van Berkel |
| 2,243,637 | A | | 5/1941 | Landis et al. |
| 2,394,923 | A | * | 2/1946 | Little ..... 55/337 |
| 2,397,980 | A | | 4/1946 | Petri |
| 2,507,976 | A | | 5/1950 | Hull |
| 2,542,634 | A | | 2/1951 | Davis et al. |
| 2,597,690 | A | | 5/1952 | Wied |
| 2,639,001 | A | | 5/1953 | Meyerhoefer |
| 2,648,396 | A | | 8/1953 | Kirby |
| 2,905,267 | A | | 9/1959 | Thompson |
| 3,311,290 | A | | 3/1967 | Szymczak et al. |
| 3,416,001 | A | | 12/1968 | Fistell |
| 3,484,890 | A | * | 12/1969 | Case ..... 15/346 |
| 3,510,904 | A | | 5/1970 | Lagerstrom |
| 3,597,902 | A | | 8/1971 | Williams |

(Continued)

FOREIGN PATENT DOCUMENTS

| | | |
|---|---|---|
| DE | 102011078413 | 1/2013 |
| EP | 0042723 | 12/1981 |
| FR | 620628 | 4/1927 |

*Primary Examiner* — Timothy V Eley

(74) *Attorney, Agent, or Firm* — Stephen R. Valancius

(57) ABSTRACT

A vacuum may include a housing, a filter, a motor-fan assembly, and a flue. The housing defines a chamber having a circular cross-section. The filter may have an annular shape and is disposed in the chamber of the housing. The motor-fan assembly includes a motor drivably coupled to a fan, such that the fan is mounted above the motor. The motor and the fan are enclosed in a casing, and the casing is disposed in an opening of the filter. The fan draws air into the chamber via the intake port and upward through the filter into the casing of the motor-fan assembly. The flue defines an exhaust path from the casing to the exhaust port, whereby air drawn into the casing is discharged via the flue outside the chamber of the vacuum.

20 Claims, 11 Drawing Sheets

(56) References Cited

U.S. PATENT DOCUMENTS

| | | | | |
|---|---|---|---|---|
| 3,815,172 | A | 6/1974 | Fromknect et al. | |
| 3,877,902 | A | 4/1975 | Eriksson et al. | |
| 4,054,802 | A | 10/1977 | Mock | |
| 4,268,288 | A | 5/1981 | Coombs | |
| 4,377,882 | A | 3/1983 | Dyson | |
| 4,658,707 | A | 4/1987 | Hawkins et al. | |
| 4,825,140 | A | 4/1989 | St. Louis | |
| 5,062,870 | A | 11/1991 | Dyson | |
| 5,099,157 | A | 3/1992 | Meyer | |
| 5,120,983 | A | 6/1992 | Samann | |
| 5,125,190 | A | 6/1992 | Buser et al. | |
| 5,177,985 | A * | 1/1993 | Igarashi et al. | 66/168 |
| 5,199,963 | A | 4/1993 | Scarp | |
| 5,256,906 | A | 10/1993 | Tsuge et al. | |
| 5,267,371 | A | 12/1993 | Soler et al. | |
| 5,270,576 | A | 12/1993 | Kahle | |
| 5,307,538 | A | 5/1994 | Rench et al. | |
| D347,778 | S | 6/1994 | Clowers et al. | |
| 5,384,984 | A | 1/1995 | Smith | |
| 5,518,442 | A | 5/1996 | Clowers et al. | |
| 5,541,457 | A | 7/1996 | Morrow | |
| 5,563,455 | A | 10/1996 | Cheng | |
| D376,304 | S | 12/1996 | Clowers et al. | |
| 5,731,947 | A | 3/1998 | Hirose | |
| 5,791,977 | A | 8/1998 | Clowers et al. | |
| 5,934,985 | A | 8/1999 | Clowers et al. | |
| 5,941,765 | A | 8/1999 | Taylor | |
| 5,955,791 | A | 9/1999 | Irlander | |
| 6,162,287 | A | 12/2000 | Rohn et al. | |
| 6,174,350 | B1 | 1/2001 | Rohn et al. | |
| 6,175,988 | B1 | 1/2001 | White et al. | |
| 6,192,551 | B1 | 2/2001 | Roth | |
| 6,224,471 | B1 | 5/2001 | Clowers et al. | |
| 6,312,508 | B1 | 11/2001 | Alberts, III et al. | |
| 6,361,587 | B1 | 3/2002 | Rohn et al. | |
| 6,391,101 | B2 | 5/2002 | Gustafson et al. | |
| D468,608 | S | 1/2003 | Wacker et al. | |
| 6,506,107 | B2 | 1/2003 | Clowers et al. | |
| 6,565,637 | B2 | 5/2003 | Alberts, III et al. | |
| 6,616,722 | B1 * | 9/2003 | Cartellone | 55/459.3 |
| D490,676 | S | 6/2004 | Wright | |
| 6,746,321 | B2 | 6/2004 | Link | |
| D497,090 | S | 10/2004 | Wacker et al. | |
| D497,297 | S | 10/2004 | Wacker et al. | |
| 6,910,245 | B2 | 6/2005 | Hawkins et al. | |
| D509,417 | S | 9/2005 | Wikle et al. | |
| D509,722 | S | 9/2005 | Wikle et al. | |
| D510,849 | S | 10/2005 | Carlson et al. | |
| 7,118,609 | B2 | 10/2006 | Valentini | |
| 7,163,568 | B2 | 1/2007 | Sepke et al. | |
| D536,942 | S | 2/2007 | Cooper et al. | |
| 7,182,150 | B2 | 2/2007 | Grossman | |
| D538,122 | S | 3/2007 | Etter et al. | |
| D548,556 | S | 8/2007 | Stratford | |
| 7,270,598 | B2 | 9/2007 | Dutterer et al. | |
| 7,282,074 | B1 * | 10/2007 | Witter | 55/300 |
| D558,017 | S | 12/2007 | Cooper et al. | |
| 7,526,866 | B2 | 5/2009 | Schnell et al. | |
| 7,601,189 | B2 | 10/2009 | Lampinen et al. | |
| 7,644,469 | B2 | 1/2010 | Beers et al. | |
| 7,887,611 | B2 | 2/2011 | Asal et al. | |
| 7,962,994 | B2 | 6/2011 | Beers | |
| 8,015,657 | B2 | 9/2011 | Beers et al. | |
| 8,015,660 | B2 | 9/2011 | Bruntner | |
| 8,015,661 | B2 | 9/2011 | Baer et al. | |
| 8,152,602 | B2 | 4/2012 | Guth | |
| 8,800,682 | B2 * | 8/2014 | Walker | 173/198 |
| 2002/0189048 | A1 | 12/2002 | Maruyama | |
| 2005/0108849 | A1 | 5/2005 | Lam | |
| 2011/0219570 | A1 | 9/2011 | Conrad | |
| 2013/0091815 | A1 * | 4/2013 | Smith | 55/346 |

* cited by examiner

COMPACT VACUUM AND SANDER

FIELD

The present disclosure relates to a vacuum that has a compact configuration.

BACKGROUND

Portable vacuum cleaners, such as a drum type vacuum or a shop vac, are well known in the industry.

A conventional portable vacuum cleaner may include a canister and a motor-fan assembly disposed above the canister. The motor-fan assembly may include a housing that is detachable from the canister and houses the fan and the motor. The motor is typically arranged above the fan, such that as the motor drives the fan, the fan draws in air and debris into the canister via an intake port. The canister may be a cylindrical like drum that collects the debris drawn in by the fan.

By having the fan and the motor disposed above the canister, the portable vacuum has a high center of gravity which may cause the portable vacuum to tip over. In addition, due to the cylinder like canister and the separate detachable housing that holds the motor and the fan, the size of the portable vacuum may become excessive, thereby making it cumbersome to transport.

This section provides background information related to the present disclosure which is not necessarily prior art.

SUMMARY

This section provides a general summary of the disclosure, and is not a comprehensive disclosure of its full scope or all of its features.

A vacuum includes a housing, a filter, a motor-fan assembly, and a flue. The housing may define a chamber having a circular cross-section and an intake port and an exhaust port. The filter may have an annular shape with an opening defined at a center of the filter. The filter may be disposed in the chamber of the housing.

The motor-fan assembly may have a motor that is drivably coupled to a fan, such that the fan is mounted above the motor. The motor and the fan may be enclosed in a casing, and the casing may be disposed in the opening of the filter. The casing is fluidly coupled to the chamber of the housing and the fan is configured to draw air into the chamber via the intake port and upward through the filter into the casing of the motor-fan assembly.

The flue defines an exhaust path from inside the casing to the exhaust port such that air drawn into the casing is discharged via the flue outside the chamber of the vacuum.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
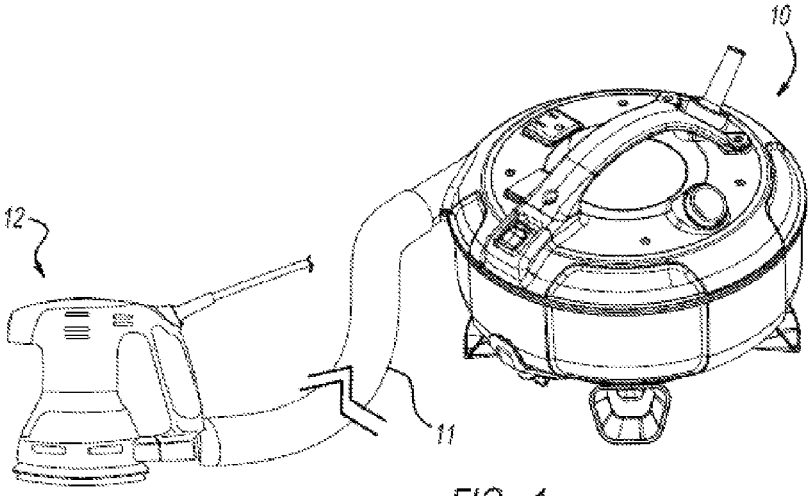
FIG. 1 is perspective view of a compact vacuum coupled to a sander.
Figure 2:
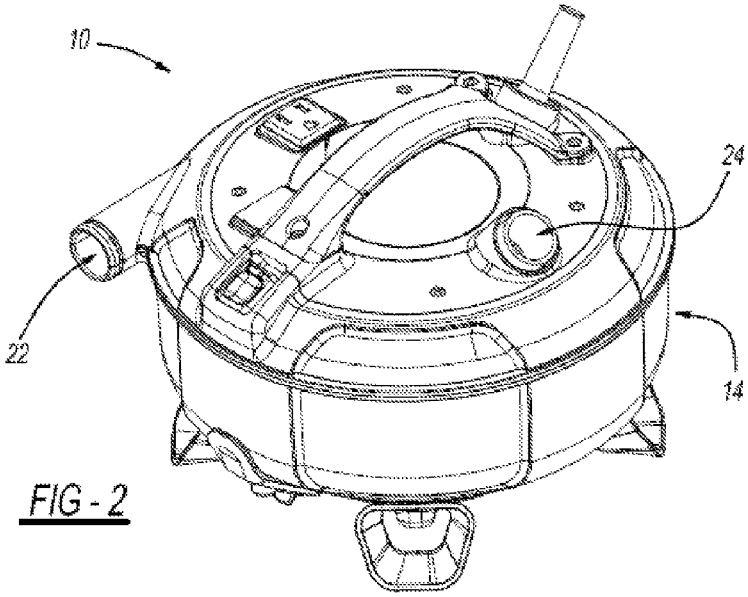
FIG. 2 is a perspective view of the compact vacuum of FIG. 1.
Figure 3:
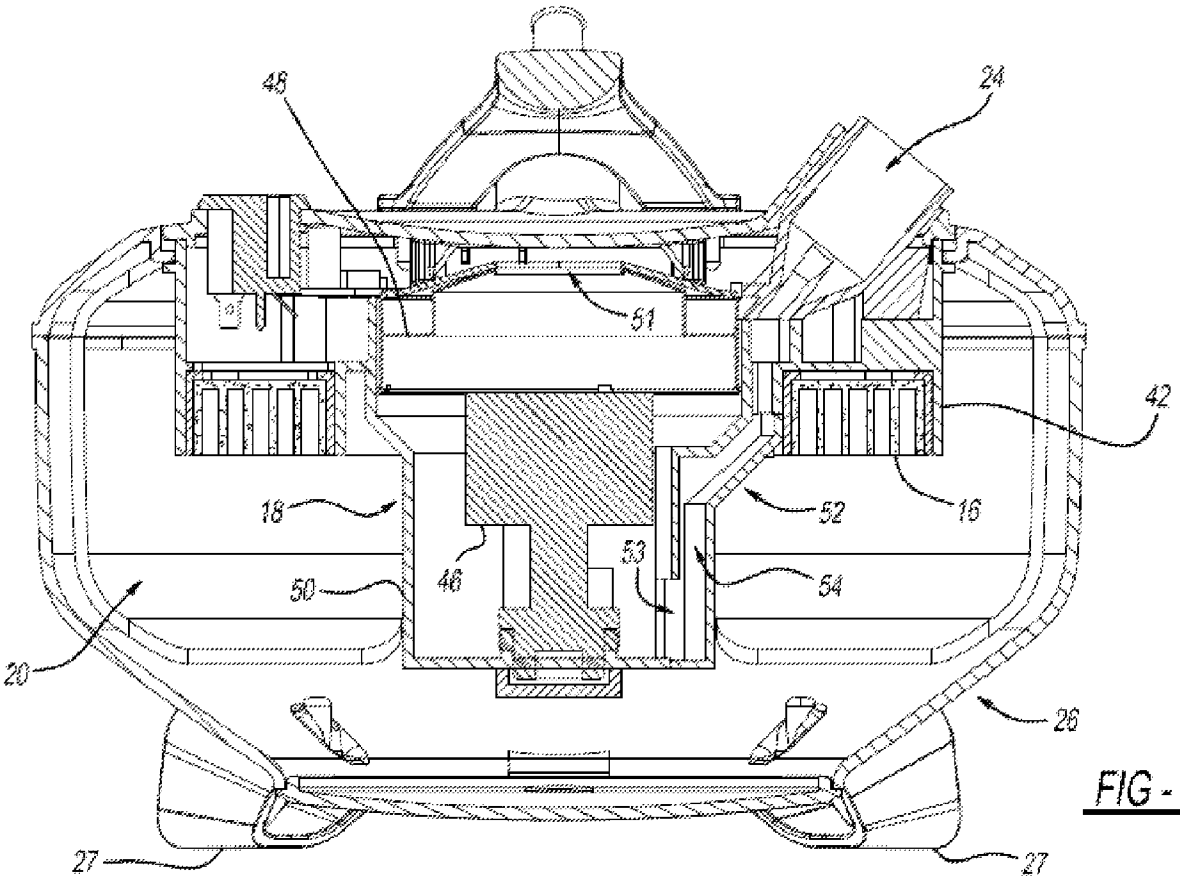
FIG. 3 is a cross-sectional view of the compact vacuum.
Figure 4:
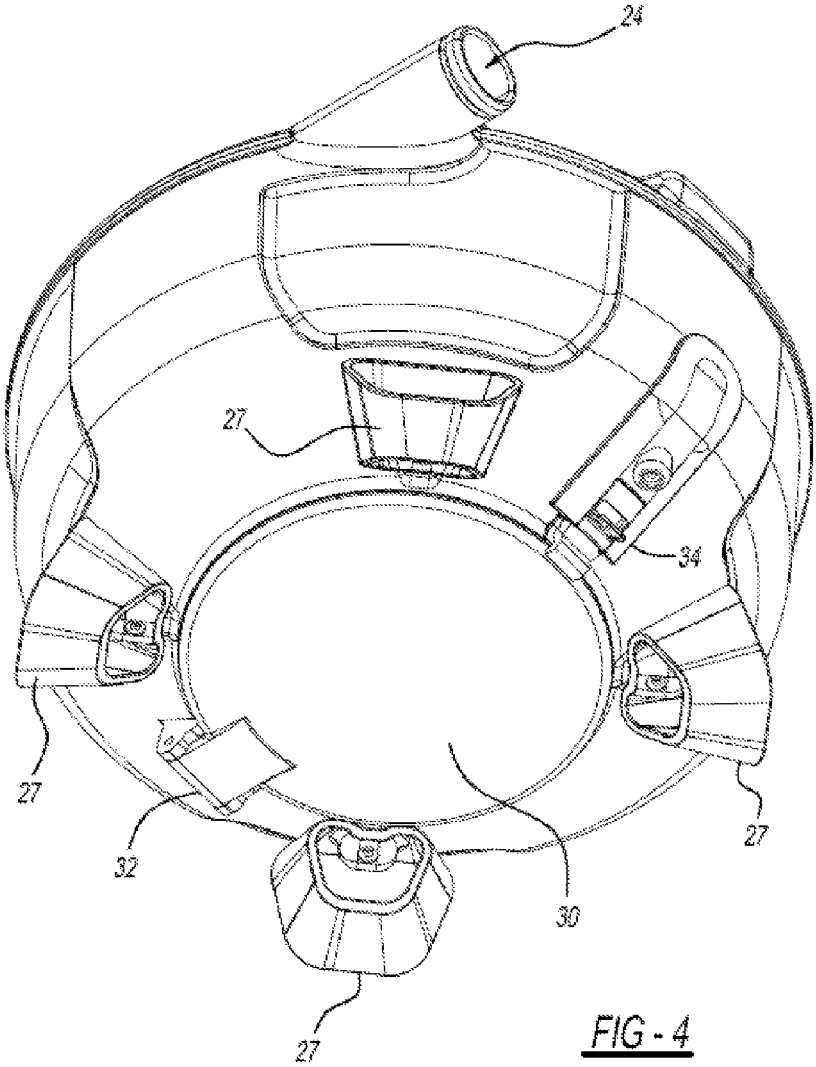
FIG. 4 is a perspective bottom view of the compact vacuum.
Figure 5:
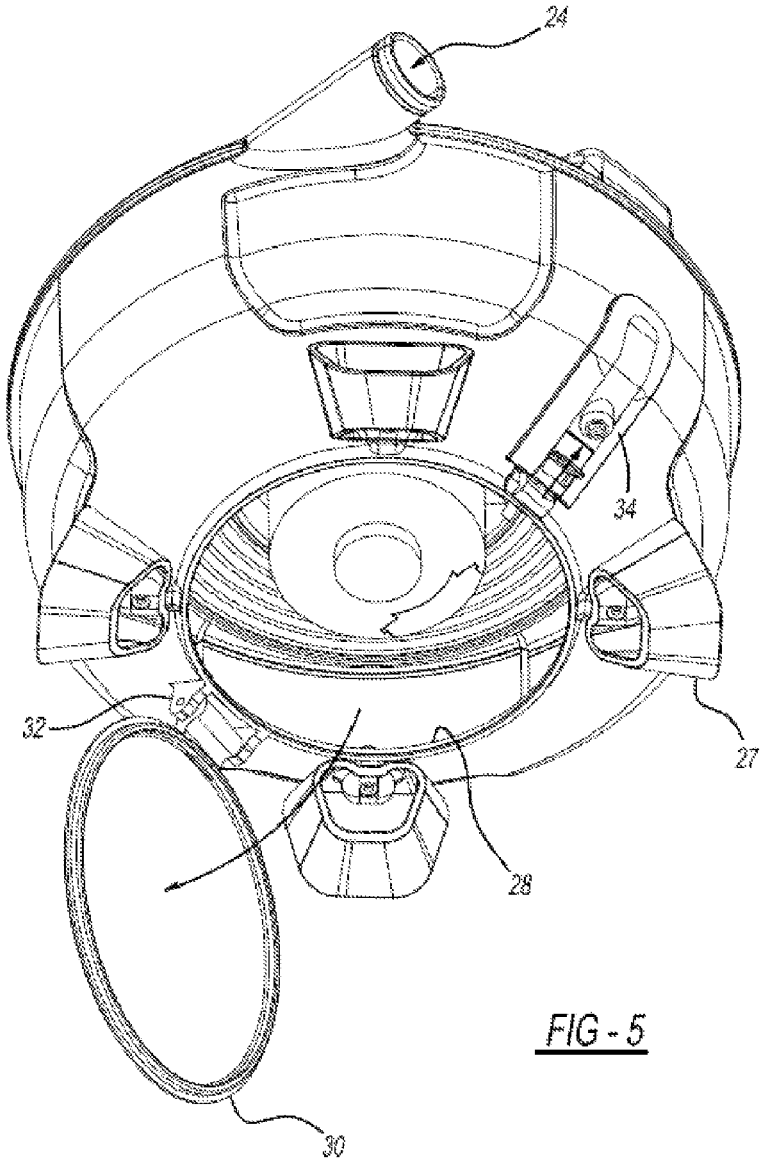
FIG. 5 is a perspective view depicting a door and an outlet of the compact vacuum.

The present disclosure will now be described more fully with reference to the accompanying drawings. With reference to FIGS. 1-3, an example of a compact vacuum 10 of the present disclosure is now presented. The compact vacuum 10 is a portable vacuum that can be attached to various suitable devices or attachments. For example, as shown in FIG. 1, the vacuum 10 is coupled to a sander 12 by way of a hose 11. The sander 12 removes surface material from an object, such as a piece of wood. The vacuum 10 sucks in air and the surface material removed by the sander 12. It would be appreciated by one skilled in the art that the vacuum 10 may be coupled to other components and is not limited to the sander 12.

The vacuum 10 includes a housing 14, a filter 16, and a motor-fan assembly 18. The filter 16 and the motor-fan assembly 18 are disposed within the housing 14. The housing 14 may have a bowl shape or cylindrical shape body. Specifically, the housing 14 defines a chamber 20 that has a circular cross-section. The housing 14 also defines an intake port 22 and an exhaust port 24. The vacuum 10 draws in air by way of the intake port 22 and discharges air by way of the exhaust port 24. The chamber 20 retains debris drawn in by the vacuum 10 and houses the filter 16 and the motor-fan assembly 18.

The intake port 22 may extend tangentially from the housing 14. The exhaust port 24 may extend along an upper surface of housing 14 at a predetermined angle to control the direction at which the air is discharged from the vacuum 10. In the example embodiment, the exhaust port 24 extends at a 45° angle from the upper surface, such that the air is discharged offset from a vertical axis of the vacuum 10, thereby preventing the air to discharge directly above the vacuum 10. In an alternative embodiment, the exhaust port 24 may extend at a 90° angle such that it is parallel with the upper surface of the housing 14. The exhaust port 24 and the intake port 22 may be arranged at various other positions along the housing 14, and are not limited to the positions and configurations depicted in the drawing.

In the example embodiment, the housing 14 has a base 26 at a lower portion of the housing 14. The base 26 may be tapered toward a center of the housing 14, such that a diameter of the chamber 20 decreases at the base 26. For example, the body of the housing 14 may be tapered at a 45° angle to form the base 26. The body of the housing 14 may be tapered at another suitable angle, and is not limited to 45°.

The vacuum 10 may further include a plurality of legs 27 disposed along an outer surface of the base 26. The legs 27 may be arranged equidistant from each other. The legs 27 elevate the housing 14 from a surface on which the vacuum 10 is positioned by a predetermined distance. In an alternative embodiment, the housing 14 may include a plurality of wheels instead of the legs 27. The wheels elevate the housing 14 and provide a mechanism for moving the vacuum 10 along the surface.

With reference to FIGS. 3-8C, the housing 14 may define an outlet 28 at the lower portion of the housing 14. The outlet 28 is defined along an edge of the base 26. The outlet 28 may be closed or covered by a door 30. The outlet 28 allows access to the chamber 20 and the filter 16. For instance, the outlet 28 may be used to expel debris stored in the chamber 20 and to access the filter 16 which may need to be cleaned or replaced.

Figure 6:
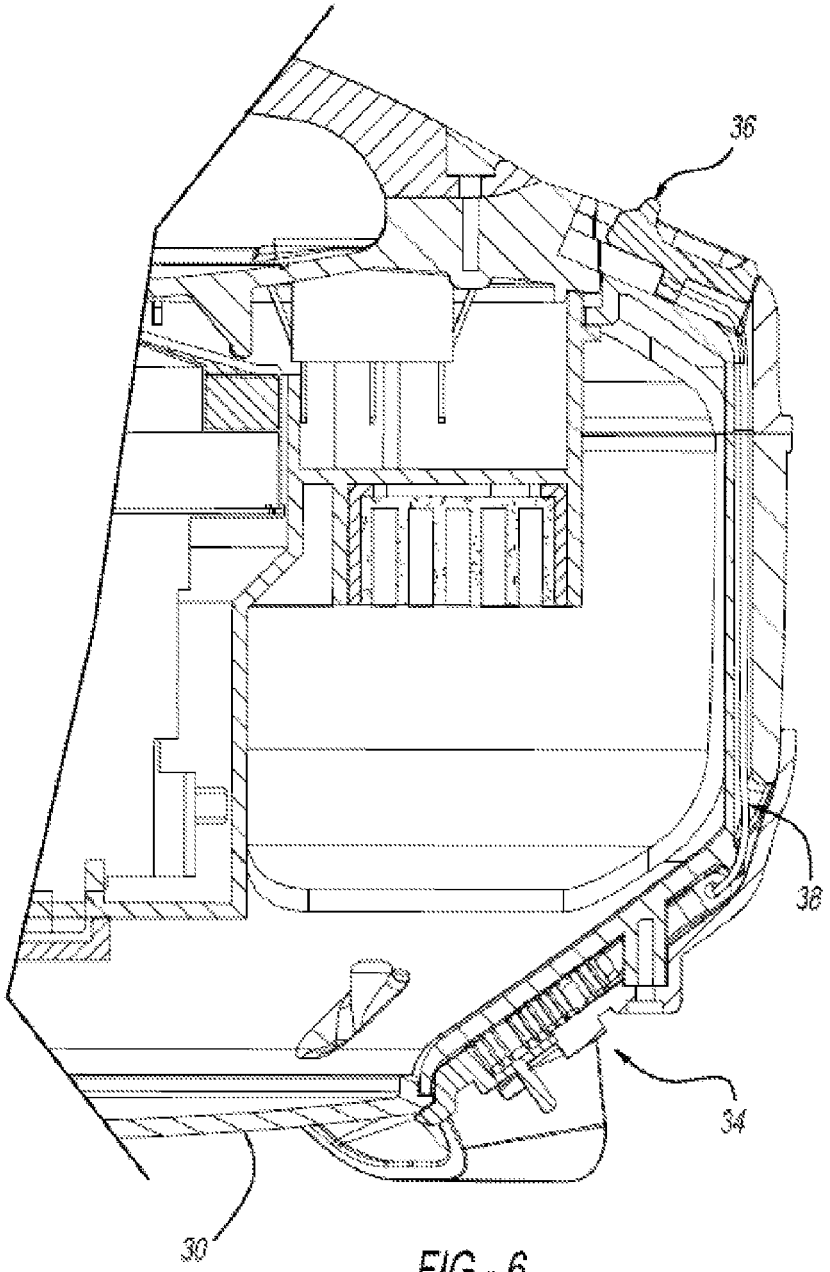
FIG. 6 is a partial cross-sectional view depicting a linkage between an actuator and a lock of the compact vacuum.
Figure 7A:
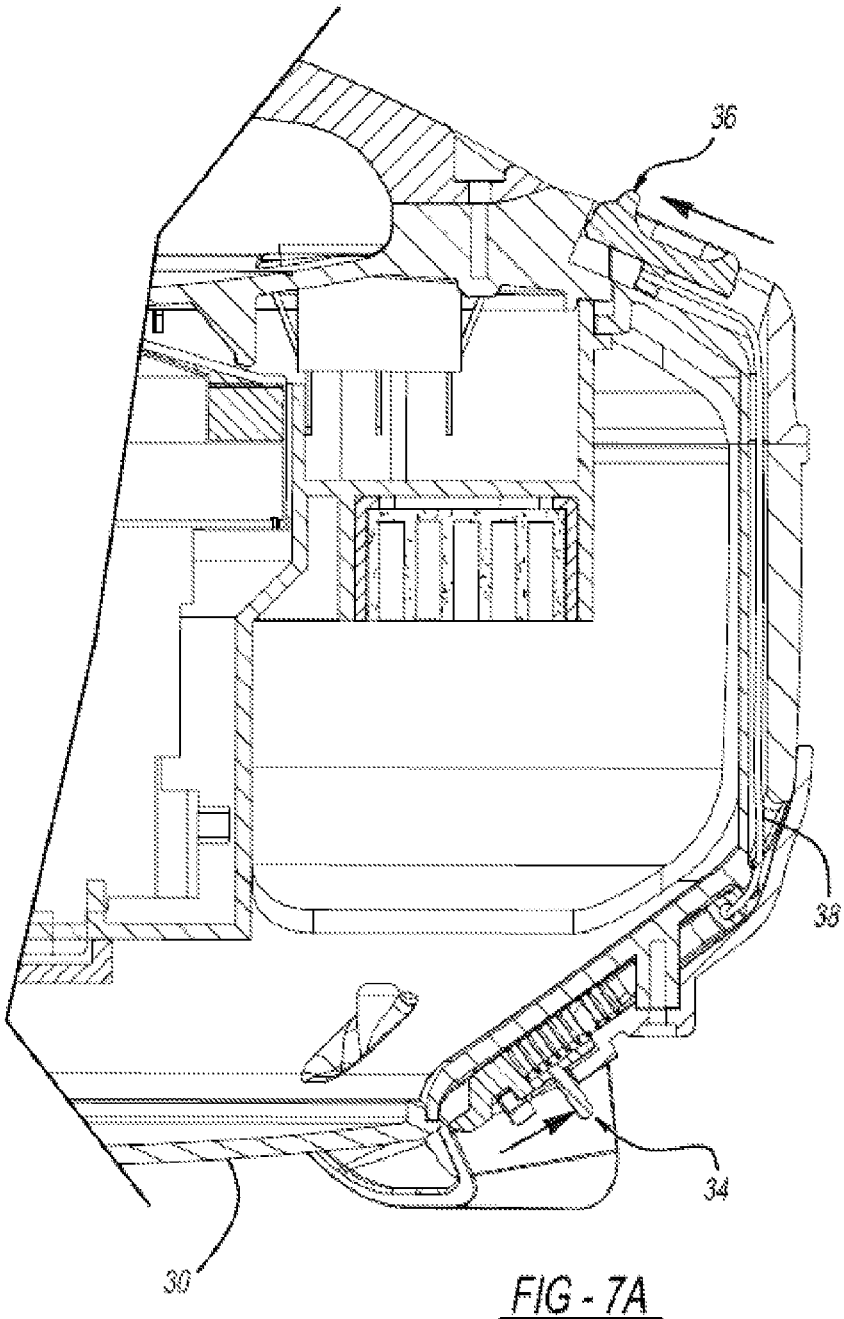
FIGS. 7A-7B are partial cross-sectional views depicting an operation of the actuator and the lock of the compact vacuum.
Figure 7B:
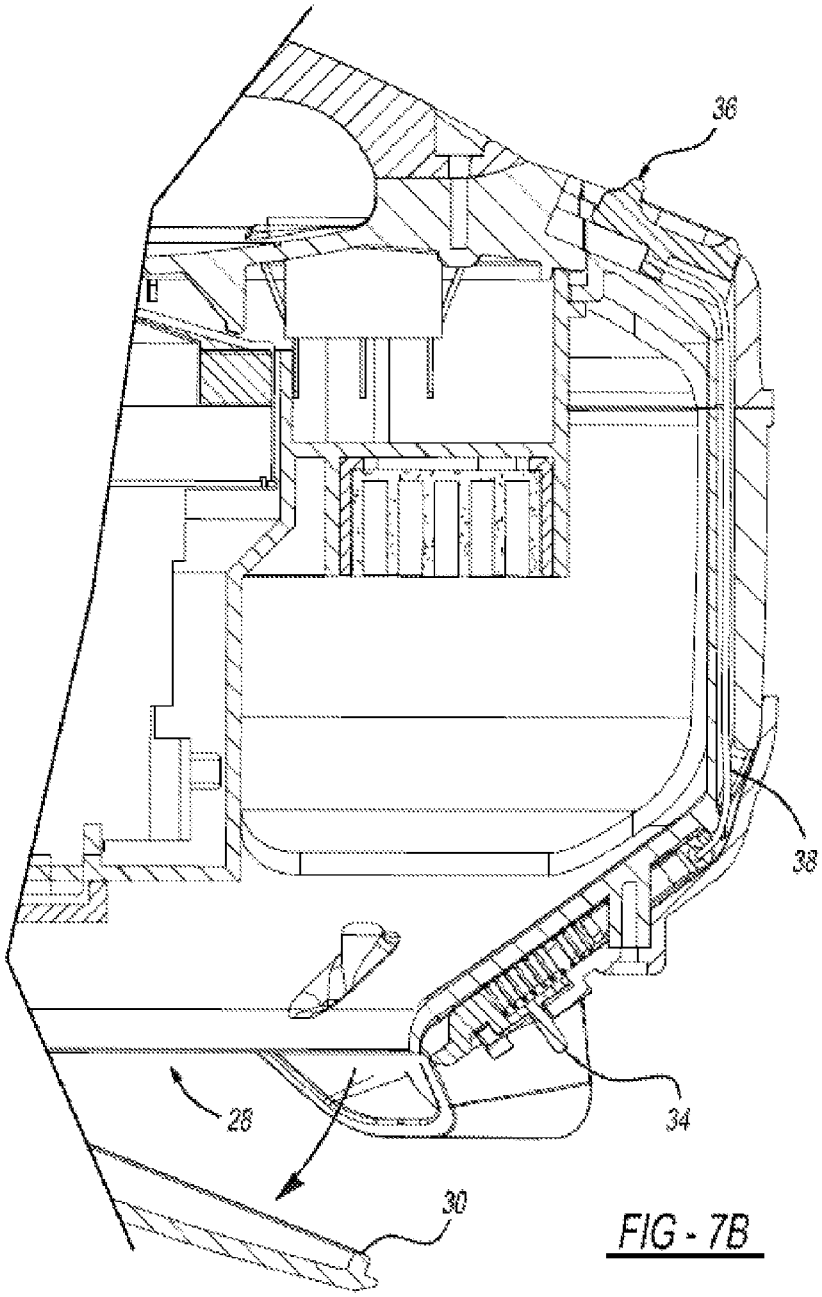

The door 30 is coupled to the housing 14 at the outlet 28 via a hinge 32 and a lock 34. Specifically, the hinge 32 couples the door 30 to the housing 14 at one end of the door 30, such that the door 30 may pivot about the hinge 32 and remain coupled to the housing 14 via the hinge 32. The lock 34 detachably couples the door 30 to the housing 14 at the other end of the door 30 opposite the hinge 32. For example, in the example embodiment, the lock 34 is a spring loaded lock. In a non-compressed state, the lock 34 extends to an edge of the door 30, thereby fastening the door 30 to the housing 14 (FIG. 6). In a compressed state, the lock 34 retracts from the door 30, thereby unfastening the door 30 from the housing 14 (FIG. 7A). Accordingly, the lock 34 may be actuated to open or fasten the door 30, and, therefore, may be a first mechanism to open the door 30. It would be appreciated by one skilled in the art that the lock 34 may be another suitable type of lock and is not limited to a spring loaded lock.

The door 30 covers the outlet 28 when the lock 34 couples the door 30 to the housing 14 and uncovers the outlet 28 when the lock 34 decouples the door 30 from the housing 14 and the door 30 moves away from the outlet 28 via the hinge 32. To refasten the door 30 to the housing 14, the door 30 may pivot toward the outlet 28 until the door 30 contacts the lock 34. Upon applying a predetermined amount of force to the door 30, the lock 34 retracts allowing the door 30 to pass the lock 34 and cover the outlet 28. The lock 34 then extends over the door 30, thereby fastening the door 30 to the housing 14. Alternatively, when the door 30 contacts the lock 34, the lock 34 may be actuated (in the compressed state) to retract the lock 34 from the edge of the housing 14. The door 30 may then cover the outlet 28 and align with the edge of the housing 14. The lock 34 may then be released (in the non-compressed state) to fasten the door 30 to the housing 14.

The vacuum 10 may include an actuator 36 as a second mechanism for opening the door 30. The actuator 36 may be disposed on the upper surface of the housing 14. The actuator 36 is coupled to the lock 34 via a linkage 38. The linkage 38 may extend within the chamber 20 of the housing 14. The door 30 may be opened and/or closed by way of the actuator 36, the linkage 38, and the lock 34. Specifically, when the actuator 36 is actuated, the linkage 38 retracts the lock 34, thereby placing the lock 34 in a compressed state (as indicated by arrows in FIG. 7A). The door 30 is decoupled from the housing 14 and then uncovers the outlet 28 as it pivots away from the housing 14 (as indicated by the arrow in FIG. 7B). It would be appreciated by one skilled in the art that the actuator 36 may be another suitable type of actuator and is not limited to the one depicted in the figures. For example, the actuator 36 may be a push-button type actuator. In an alternative embodiment, the vacuum 10 may not include the second mechanism (the actuator 36), and may only include the lock 34 as a mechanism for opening the door 30.

With continuing reference to FIGS. 2-3, the filter 16 is disposed within the chamber 20 of the housing 14. The filter 16 may have an annular shape (a donut-like shape), and defines an opening 40 at a center of the filter 16. The filter 16 may be disposed within a filter casing 42. The filter casing 42 may have an annular shape. Specifically, when assembled, the filter casing 42 may extend circumferentially around an outer perimeter of the filter 16. The filter casing 42 may also extend along an upper surface of the filter 16 (FIG. 8B). The filter casing 42 may define a plurality of vents 44 above the upper surface of the filter 16. The filter casing 42 may be formed by the housing 14 or may be a separate component that is coupled to the housing 14.

The motor-fan assembly 18 is disposed within the chamber 20 of the housing 14. The motor-fan assembly 18 includes a motor 46 that is drivably coupled to a fan 48. The fan 48 is mounted above the motor 46. The motor 46 and the fan 48 are enclosed in a motor-fan casing 50. Specifically, the motor-fan casing 50 houses the fan 48 and the motor 46 within the housing 14. The motor-fan casing 50 may be formed by the housing 14 within the chamber 20 or may be a separate component coupled to the housing 14. In the example embodiment, the motor-fan casing 50 is disposed within the opening 40 of the filter 16. The motor-fan casing 50 is fluidly coupled to the chamber 20 of the housing 14, such that air flowing through the chamber 20 flows through the motor-fan casing 50. For example, in the example embodiment, the motor-fan casing 50 defines a first aperture 51 at an upper portion of the casing 50 above the fan 48. The air is drawn through the first aperture 51 by the fan 48 as described in detail below. The first aperture 51 may be disposed in various other suitable positions along the motor-fan casing 50 and is not limited to the position depicted in the figures.

The vacuum 10 further includes a flue 52 disposed within the chamber 20. The flue 52 fluidly couples the motor-fan assembly 18 to the exhaust port 24. In the example embodiment, the motor-fan casing 50 defines a second aperture 53 at a lower portion of the casing 50 adjacent to the motor 46. The flue 52 couples the second aperture 53 to the exhaust port 24 by defining an exhaust path 54 from the motor-fan casing 50 to the exhaust port 24. In the example embodiment, the flue 52 extends between the filter casing 42 and the motor-fan casing 50. It would be appreciated by one skilled in the art that the configuration of the flue 52 may vary based on the configurations of the exhaust port 24 and the second aperture 53 of the motor-fan casing 50 and is not limited to the configuration depicted in the figures.

Figure 9A:
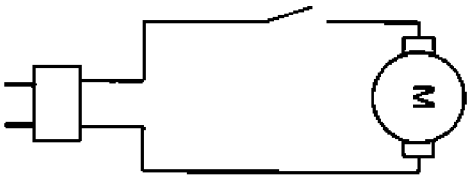
FIGS. 9A and 9B are circuit diagrams depicting a master circuit and a slave circuit.
Figure 9B:
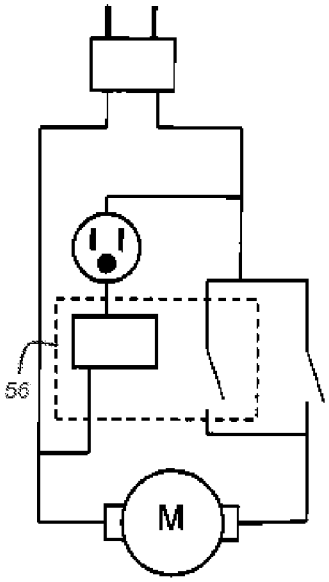

The vacuum 10 may be electrically coupled to a power outlet via a power cord. The power outlet may provide the standard 120V 15 A (or more) of power to the vacuum 10. In addition, the vacuum may be turned ON/OFF via a switch disposed along the housing 14. Alternatively, the vacuum 10 may be turned ON/OFF by way of an electric device it is coupled to. For example, the vacuum 10 may be electrically coupled to the sander 12 such that when the sander 12 is turned ON/OFF, the vacuum 10 is turned ON/OFF. The vacuum 10 may be a slave and the sander 12 (i.e., the electric device) may be a master (M). The sander 12 and the vacuum 10 are represented in the master/slave circuit diagrams of FIGS. 9A and 9B, respectively. The master is coupled to the slave via a relay 56. Accordingly, when the master is turned ON, current flows through the relay 56 and the slave is turned ON. Conversely, when the master is turned OFF, the relay 56 no longer receives current and the slave is turned OFF. It should be understood to one skilled in the art that various suitable master/slave circuit configurations may be employed and are not limited to the circuits depicted in FIGS. 9A and 9B.

Figure 8A:
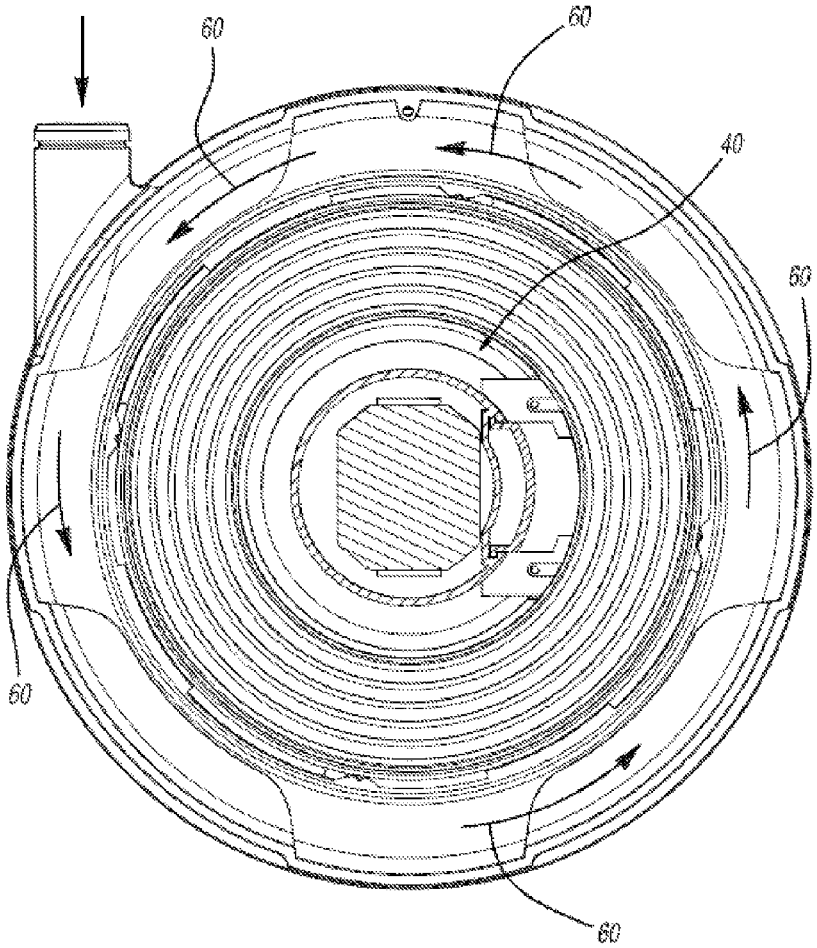
FIGS. 8A-8C are perspective views depicting air flow within the compact vacuum.
Figure 8B:
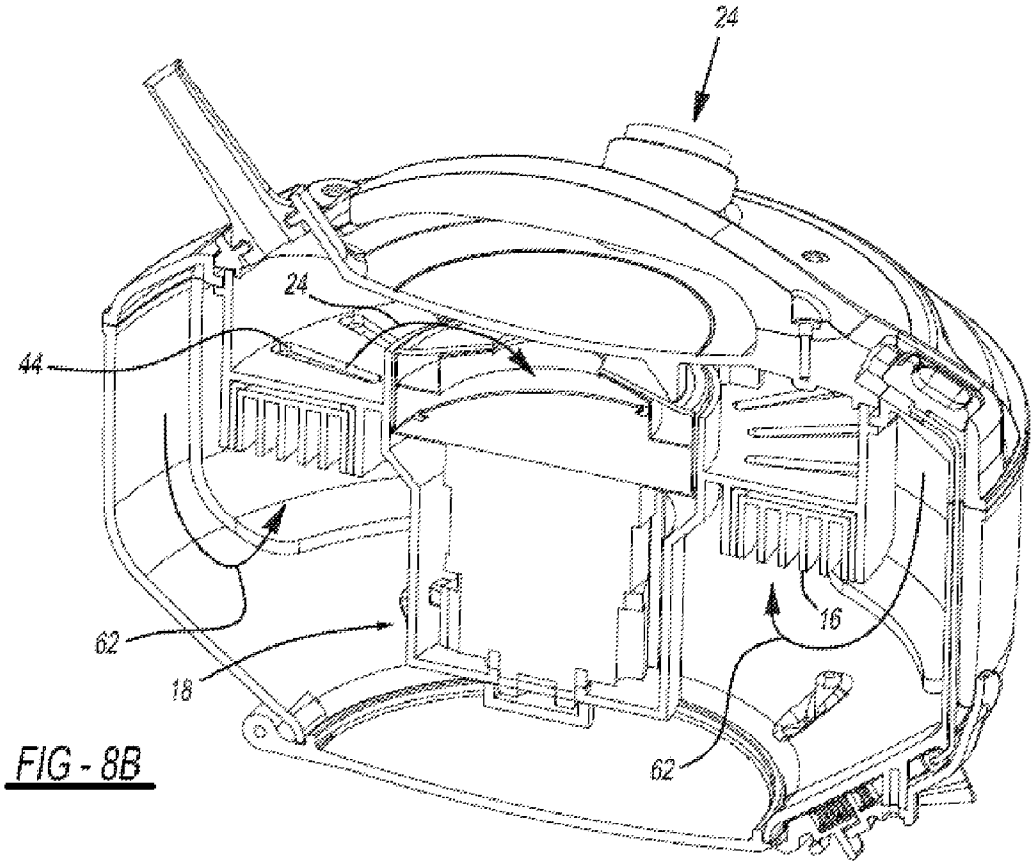
Figure 8C:
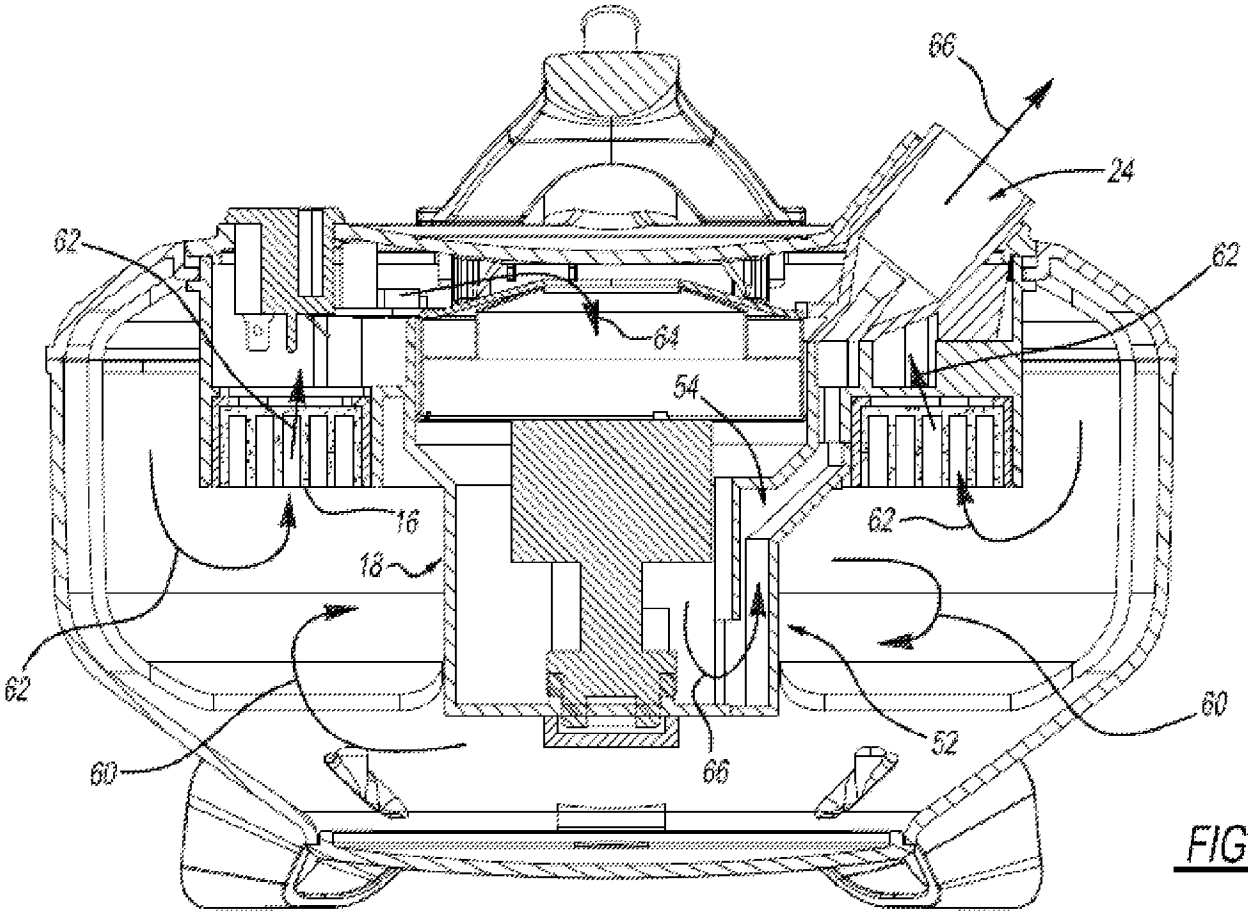

With continuing reference to FIGS. 8A-8C, an exemplary illustration of the flow of air within the vacuum 10 is now presented. When in operation, the vacuum 10 draws in air via the intake port 22. Specifically, the motor 46 drives the fan 48 which draws in air into the vacuum 10 via the intake port 22. The air may include debris, such as dust, dirt, small objects, etc. The air circulates within the chamber 20 of the housing 14 in a cyclonic fashion (illustrated by arrows 60 in FIGS. 8A and 8C).

The filter casing 42 and the chamber 20 may form a circular path along which the air circulates. As the air circulates within the chamber 20, some of the debris sucked in with the air falls toward the base 26 of the housing 14. Accordingly, debris collects at the base 26 and the outlet 28 of the housing 14.

The fan 48 draws the air upward through the filter 16 and the vents 44 (as illustrated by arrows 62 in FIGS. 8B and 8C). The filter 16 removes fine particles of debris from the air flowing through. From the filter 16, the air is drawn downward into the motor-fan casing 50 by the fan 48 (as illustrated by arrow 64 in FIGS. 8B and 8C). Specifically, in the example embodiment, the air flows through the first aperture 51 of the motor-fan casing 50. The fan 48 draws the air downward through the fan 48 and the motor 46. From the motor 46, the flue 52 discharges the air drawn into the motor-fan casing 50. Specifically, the air flows through the exhaust path 54 via the second aperture 53 and out through the exhaust port 24 (as illustrated by arrows 66 in FIG. 8C).

To remove debris collected within the chamber 20 of the housing 14, the vacuum 10 allows the gradual release of the debris via the outlet 28. Specifically, the actuator 36 may be engaged to release the lock 34 and open the door 30. The door 30 pivots about the hinge 32 and opens the outlet 28. The debris, which may collect along the base 26 and the outlet 28, may be disposed into, for example, a dust bin. A slight tap or shake of the vacuum 10 may further release debris collected along the tapered side of the base 26.

By having the motor-fan assembly 18 within the housing 14 with the fan 48 mounted above the motor 46, the compact vacuum 10 of the present disclosure achieves a low center of gravity, thereby making it less apt to falling or tipping over. Furthermore, by retaining the motor-fan assembly 18 within the housing 14, the compact vacuum 10 has a small condensed size, which may be easier to transport and store than some conventional portable vacuums.

The vacuum 10 further utilizes cyclonic separation to improve filtration of the air drawn into the vacuum 10 by the fan 48. As described above, the chamber 20 and the filter casing 42 define a circular path along which the air circulates (FIG. 8A). As the air circulates, debris drawn in with the air falls to the base 26. The filter casing 42 prevents the debris from directly entering the filter 16 as it is drawn in from the intake port 22. Thus, as the air circulates within the chamber 20, larger debris may fall to the base 26 and the filter 16 may further remove fine particles of debris from the air as the air flows through the filter 16.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Numerous specific details are set forth such as examples of specific components, devices, and methods, to provide a thorough understanding of embodiments of the present disclosure. It will be apparent to those skilled in the art that specific details need not be employed, that the example embodiments may be embodied in many different forms and that neither should be construed to limit the scope of the disclosure.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, operations, elements, and/or components, but do not preclude the presence or addition of one or more other features, operations, elements, components, and/or groups thereof.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A vacuum comprising:

a housing defining a chamber having a circular cross-section and defining an intake port and an exhaust port;

a filter having an annular shape with an opening defined at a center of the filter and being disposed in the chamber of the housing;

a motor-fan assembly having a motor drivably coupled to a fan, such that the fan is mounted above the motor, the motor and the fan are enclosed in a casing, and the casing is disposed in the opening of the filter, wherein the casing is fluidly coupled to the chamber and the fan is configured to draw air into the chamber via the intake port and upward through the filter into the casing of the motor-fan assembly; and a flue defining an exhaust path from inside of the casing to the exhaust port, whereby air drawn into the casing is discharged via the flue outside the chamber of the vacuum.

2. The vacuum of claim 1, wherein the housing has an upper portion and a lower portion, the upper portion has a first diameter, the lower portion tapers inwards towards a center of the chamber to a second diameter, and the first diameter is greater than the second diameter.

3. The vacuum of claim 1 further comprising:

a door;

a hinge pivotably coupling the door to the housing at one end of the door; and a lock detachably coupling the door to the housing at a second end of the door opposite of the hinge; wherein the housing includes a base that defines an outlet, and the door covers the outlet when the lock couples the door to the housing and uncovers the outlet when the lock decouples the door from the housing and the door pivots away from the outlet via the hinge.

4. The vacuum of claim 3 further comprising:

an actuator coupled to the lock, wherein the actuator decouples the lock from the door when the actuator is engaged.

5. The vacuum of claim 1, wherein the flue couples a portion of the casing which holds the motor to the exhaust port.

6. The vacuum of claim 1, wherein the exhaust port is arranged at a 45 degree angle from an upper surface of the housing.

7. The vacuum of claim 1 wherein the flue couples a portion of the casing which holds the motor to the exhaust port.

8. The vacuum of claim 1 further comprising:

a filter casing having an annular shape and being disposed within the chamber, wherein the filter casing houses the filter and extends circumferentially around an outer surface of the filter.

9. The vacuum of claim 1, wherein the housing has an upper portion that has a first diameter and a lower portion that has a decreasing diameter from the first diameter to a second diameter, the first diameter is greater than the second diameter, and the housing defines an outlet at a location that has the second diameter.

10. A vacuum comprising:

a housing defining a chamber having a circular cross-section and defining an intake port and an exhaust port;

a filter having an annular shape with an opening defined at a center of the filter and being disposed in the chamber of the housing;

a motor-fan assembly having a motor drivably coupled to a fan, such that the fan is mounted above the motor, the motor and the fan are enclosed in a casing, the casing defining a first aperture at an upper portion of the casing adjacent to the fan and a second aperture at a lower portion of the casing adjacent to the motor, and the casing being disposed in the opening of the filter, wherein the casing is fluidly coupled to the chamber and the fan is configured to draw air into the chamber via the intake port and upward through the filter into the casing of the motor-fan assembly via the first aperture; and a flue which fluidly couples the second aperture of the casing to the exhaust port, whereby air drawn into the casing is discharged via the flue outside the chamber of the vacuum.

11. The vacuum of claim 10, wherein the housing has an upper portion that has a first diameter and a lower portion that has a decreasing diameter from the first diameter to a second diameter, the first diameter is greater than the second diameter, and the housing defines an outlet at a location that has the second diameter.

12. The vacuum of claim 11 further comprising:

a door disposed at the outlet of the housing;

a hinge pivotably coupling the door to the housing at one end of the door; and a lock detachably coupling the door to the housing at a second end of the door opposite of the hinge; wherein the door covers the outlet when the lock couples the door to the housing and uncovers the outlet when the lock decouples the door from the housing and the hinge pivots the door away from the outlet.

13. The vacuum of claim 12 further comprising:

an actuator coupled to the lock, wherein the actuator decouples the lock from the door when the actuator is engaged.

14. The vacuum of claim 10, wherein the flue extends from the second aperture to the exhaust port.

15. The vacuum of claim 10 further comprising:

a filter casing having an annular shape and being disposed within the chamber, wherein the filter is housed in the filter casing, and the filter casing extends circumferentially around an outer surface of the filter.

16. A system comprising:

a sander configured to remove surface material from an object and adapted to receive a hose; and a vacuum fluidly coupled to the sander and configured to draw in air and the surface material removed by the sander, the vacuum including:

a housing defining a chamber having a circular cross-section and defining an intake port and an exhaust port, wherein the intake port is adapted to receive the hose and the sander is coupled to the intake port via the hose, a filter having an annular shape with an opening defined at a center of the filter and being disposed in the chamber of the housing, a motor-fan assembly having a motor drivably coupled to a fan, such that the fan is mounted above the motor, the motor and the fan are enclosed in a casing, and the casing is disposed in the opening of the filter, wherein the casing is fluidly coupled to the chamber and the fan is configured to draw the air and the surface material into the chamber via the intake port, and to draw the air upward through the filter into the casing of the motor-fan assembly, and a flue defining an exhaust path from inside of the casing to the exhaust port, whereby air drawn into the casing is discharged via the flue outside the chamber of the vacuum.

17. The system of claim 16, wherein the flue couples a portion of the casing which holds the motor to the exhaust port.

18. The system of claim 16, wherein the flue couples a portion of the casing which holds the motor to the exhaust port.

19. The system of claim 16 further comprising:

a filter casing having an annular shape and being disposed within the chamber, wherein the filter casing houses the filter and extends circumferentially around an outer surface of the filter.

20. The system of claim 16, wherein the housing has an upper portion that has a first diameter and a lower portion that has a decreasing diameter from the first diameter to a second diameter, the first diameter is greater than the second diameter, and the housing defines an outlet at a location that has the second diameter.

* * * * *